US007635252B2

(12) United States Patent
Harada

(10) Patent No.: US 7,635,252 B2
(45) Date of Patent: Dec. 22, 2009

(54) SHOCK ABSORBING DEVICE FOR WATERCRAFT PROPELLER

(75) Inventor: Hiroshi Harada, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 506 days.

(21) Appl. No.: 11/516,819

(22) Filed: Sep. 7, 2006

(65) Prior Publication Data

US 2007/0053777 A1 Mar. 8, 2007

(30) Foreign Application Priority Data

Sep. 7, 2005 (JP) ..... 2005-258934

(51) Int. Cl.
*B63H 1/20* (2006.01)

(52) U.S. Cl. ..... 416/93 A; 416/43; 416/244 B

(58) Field of Classification Search ..... 416/31, 416/43, 93 A, 134 R, 135, 140, 244 B; 464/30, 464/42, 51, 89, 90
See application file for complete search history.

(56) References Cited

U.S. PATENT DOCUMENTS

| | | | | | |
|---|---|---|---|---|---|
| 2,644,420 | A * | 7/1953 | Irgens | 416/135 |
| 2,788,650 | A * | 4/1957 | Hagenlocher et al. | 464/90 |
| 3,212,296 | A * | 10/1965 | Benjamen | 464/8 |
| 3,584,473 | A * | 6/1971 | MacDonald et al. | 464/90 |
| 3,638,979 | A * | 2/1972 | Francois et al. | 403/281 |
| 3,871,324 | A * | 3/1975 | Snyder | 440/55 |
| 4,222,246 | A * | 9/1980 | Rongley | 464/30 |
| 4,317,655 | A * | 3/1982 | Schiek | 440/78 |
| 4,436,514 | A * | 3/1984 | Takahashi et al. | 440/89 R |
| 4,778,419 | A * | 10/1988 | Bolle et al. | 440/89 R |
| 4,911,663 | A * | 3/1990 | Meier | 440/49 |
| 5,470,263 | A * | 11/1995 | Griffiths et al. | 440/75 |
| 6,443,846 | B1 * | 9/2002 | Dziedzic et al. | 464/41 |
| 6,659,818 | B2 * | 12/2003 | Booe | 440/83 |
| 2002/0085914 | A1 * | 7/2002 | Chen | 416/134 R |
| 2006/0276246 | A1 * | 12/2006 | Needes et al. | 464/30 |

FOREIGN PATENT DOCUMENTS

| | | |
|---|---|---|
| JP | 59-171789 | 9/1984 |
| JP | 2000-280983 | 10/2000 |

* cited by examiner

*Primary Examiner*—Edward Look
*Assistant Examiner*—Aaron R Eastman
(74) *Attorney, Agent, or Firm*—Keating & Bennett, LLP

(57) ABSTRACT

A shock absorbing device for a watercraft propeller is provided that can include an outer tube unitarily formed with blades of a propeller. An inner tube can be coupled with a propeller shaft. An intermediate tube can be positioned between the outer tube and the inner tube. A first damping means can be placed between the intermediate tube and the outer tube. A second damping means can be placed between the intermediate tube and the inner tube. One of the damping means can include a rubber damper interposed between the inner tube and the intermediate tube, and an engaging means for limiting an angle range in which the inner tube and the intermediate tube can be rotatable relative to each other to a predetermined angle range. The rubber damper can have a spring constant with which elastic deformation thereof begins at a moment that the propeller shaft initiates its rotation. The other damping means includes a torque limiter (tolerance rings 16) having a circumferential surface that slips against frictional resistance.

16 Claims, 6 Drawing Sheets

SHOCK ABSORBING DEVICE FOR WATERCRAFT PROPELLER

CROSS-REFERENCE TO RELATED APPLICATIONS

The present application is based on and claims priority under 35 U.S.C. § 119 to Japanese Patent Application No. 2005-258934, filed on Sep. 7, 2005, the entire contents of which is expressly incorporated by reference herein.

BACKGROUND OF THE INVENTIONS

1. Field of the Inventions

The present invention relates generally to watercraft propulsion, and more specifically, to a watercraft propeller having a damper interposed between a propeller shaft and a blade of a propeller.

2. Description of the Related Art

A common watercraft propulsion device, such as an outboard motor, typically includes a propeller to produce thrust for propelling the watercraft. Some propellers incorporate a rubber damper interposed between a propeller shaft and blades. Such a propeller is disclosed, for example, in Japanese Patent Document No. JP-A-Sho 59-171789 (see pages 4 and 5, FIG. 1) (hereinafter "JP '789"). JP '789 discloses that the rubber damper can be used to dampen a shock experienced by the propeller shaft. Such a shock can be created, for example, when the propeller strikes an object such as a piece of driftwood or a rock located at the bottom of the sea while the watercraft moves in shallow water. The rubber damper helps to prevent damage to blade portions or members of a power transmission system. The rubber damper is interposed between an inner tube rotating with the propeller shaft and an outer tube having blades unitarily formed therewith and circumferentially positioned outside of the inner tube.

Japanese Patent Document No. JP-A-2000-280983 (hereinafter "JP '983"), discloses an outboard motor that has a rubber damper in a propeller power transmission system (pages 5 to 7, FIG. 7). The power transmission system disclosed in JP '983 is divided into a drive side and a driven side which meet at a portion between an engine and a propeller shaft. The rubber damper is placed at the portion where the system is divided. The rubber damper is provided to absorb a shock made during engagement of a dog clutch of a shift mechanism in the power transmission system. The rubber damper in JP '983 has a spring constant smaller than that of the rubber damper disclosed in JP '789. Thus, if any shock is transmitted to an operator of the outboard motor and passengers, it is through the outboard motor and the hull of the watercraft. Therefore, the rubber damper of JP '983 can tend to reduce the overall shock experienced by the watercraft operator and passengers, and ensure that any shock is as small as possible.

Nevertheless, the JP '983 rubber damper has such a small spring constant that it is unable to transmit the necessary torque to rotate the propeller at high speeds. Therefore, the outboard motor described in JP '983 also uses an engaging means. The engaging means limits the angular range through which two transmission members connected through the rubber damper can rotate relative to each other. The engaging means includes recessed portions formed in the one of the two metal transmission members, and protruding portions formed in the other transmission member. The protruding portions can engage with the recessed portions to limit the overall angular relative movement. Therefore, while the rubber damper in the outboard motor disclosed in JP '983 can dampen the shock made when the dog clutch engages, as the transmission torque increases, the power is directly transmitted from the one transmission member to the other transmission member through the metal recessed portions and the metal protruding portions which engage with each other.

The rubber damper disclosed in JP '789 can transmit the torque when the watercraft runs at a high speed. However, this rubber damper is not able to dampen the shock made when the dog clutch of the shift mechanism is engaged.

As mentioned above, the outboard motor disclosed in JP '983 can attenuate the shock by the rubber damper. However, even if some shock is momentarily absorbed by the rubber damper, the engaging means limits the angular relative movement of the two transmission members and thus prevents any further absorption of shock forces. Such a configuration can be problematic at high speeds.

For example, the engaging means ensure that power will continue to be transmitted from the engine to the propeller blades once the rubber damper has been maximally strained due to the engagement of the nesting metal protrusions and recesses. If the propeller strikes an object while rotating at a high speed with the metal portions of the engaging nested, some members of the power transmission system can be damaged. In particular, the propeller and other members that have relatively low rigidity are likely to be damaged.

The problem discussed above can be solved, to some extent, by mounting the propeller described in JP '789 to the outboard motor described in JP '983.

Employing such a structure is complicated however, and would require that the outboard motor have a first rubber damper disposed inside of a housing thereof and a second rubber damper disposed inside of the propeller. In order to accommodate both of the rubber dampers, the configuration of the outboard motor would have to have to be modified as well.

SUMMARY OF THE INVENTION

An aspect of at least one of the embodiments disclosed herein includes the realization that a propeller damper assembly can be configured to provide dampening of both shocks generated at low speed, such as during shifting, and shocks produced at higher speed, such as when the propeller strikes a floating or sunken object such as wood or a rock during higher speed operation.

Thus, in accordance with an embodiment, a shock absorbing device for a watercraft propeller can comprise an outer tube unitarily formed with a blade of a propeller, an inner tube positioned in the outer tube and coupled with a propeller shaft, and an intermediate tube positioned between the outer tube and the inner tube. First dampening means can be placed between the intermediate tube and the outer tube. Second dampening means can be placed between the intermediate tube and the inner tube. One of the first damping means and the second damping means can comprise an elastic member having a spring constant with which elastic deformation of the elastic member begins at a moment that the propeller shaft initiates rotation thereof, the elastic member being interposed between one of the tubes positioned inside and another one of the tubes positioned outside, and an engaging means for limiting an angle range in which said one of the tubes positioned inside and said another one of the tubes positioned outside are rotatable relative to each other to a predetermined angle range. The other of the first and second damping means comprises a torque limiter having a circumferential surface that slips against frictional resistance when transmission torque exceeds an amount of predetermined torque.

In accordance with another embodiment, a shock absorbing device for a watercraft propeller can comprise an outer tube unitarily formed with a blade of a propeller, an inner tube positioned in the outer tube and coupled with a propeller shaft, and an intermediate tube positioned between the outer tube and the inner tube. The device can also include a first dampening device placed between the intermediate tube and the outer tube and a second dampening device placed between the intermediate tube and the inner tube. One of the first and second dampening devices is fixed in place so as to absorb shocks and the other of the first and second dampening devices is fit into place so as to limit torque transmitted thereby.

BRIEF DESCRIPTION OF THE DRAWINGS

These and other features, aspects, and advantages of the present inventions are described below with reference to the drawings of preferred embodiments, which embodiments are intended to illustrate and not to limit the present inventions.

DETAILED DESCRIPTION OF THE PREFERRED EMBODIMENT

With reference to FIGS. 1 through 6, an embodiment of a shock absorbing device for a watercraft propeller 7 formed in accordance with the present invention will be described below. The propeller merely exemplifies one type of environment in which the present inventions can be used. However, the various embodiments of the shock absorbing devices disclosed herein can be used with other types of devices that benefit from shock absorption, for example, but without limitation, rotational shaft connections designed to absorb and thus prevent the transfer of shock energy from one shaft to another. Such applications will be apparent to those of ordinary skill in the art in view of the description herein. The present inventions are not limited to the embodiments described, which include the preferred embodiments, and the terminology used herein is not intended to limit the scope of the present inventions.

Figure 1:
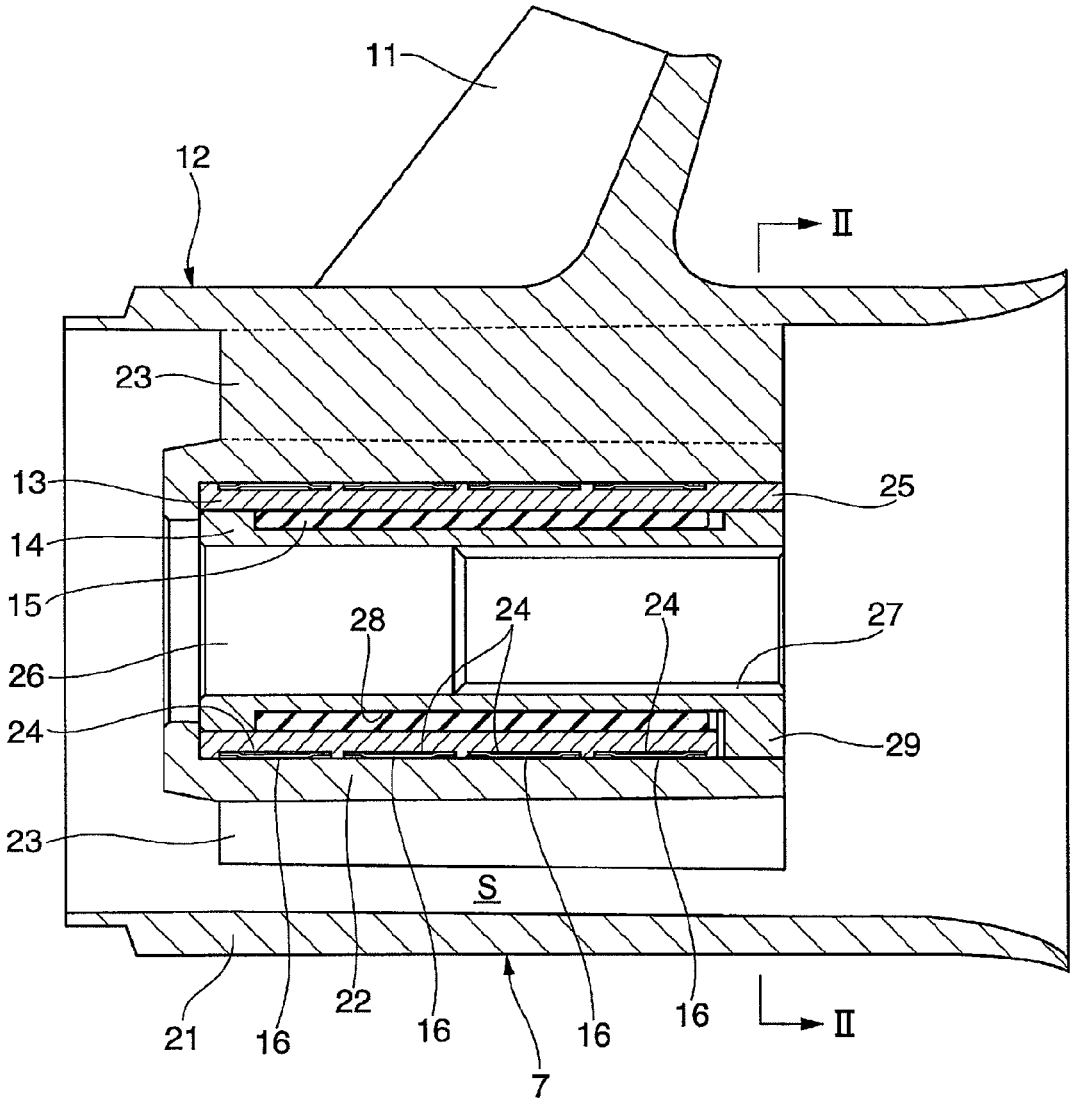
FIG. 1 is a cross sectional view of a propeller incorporating a shock absorbing device according to an embodiment.
Figure 2:
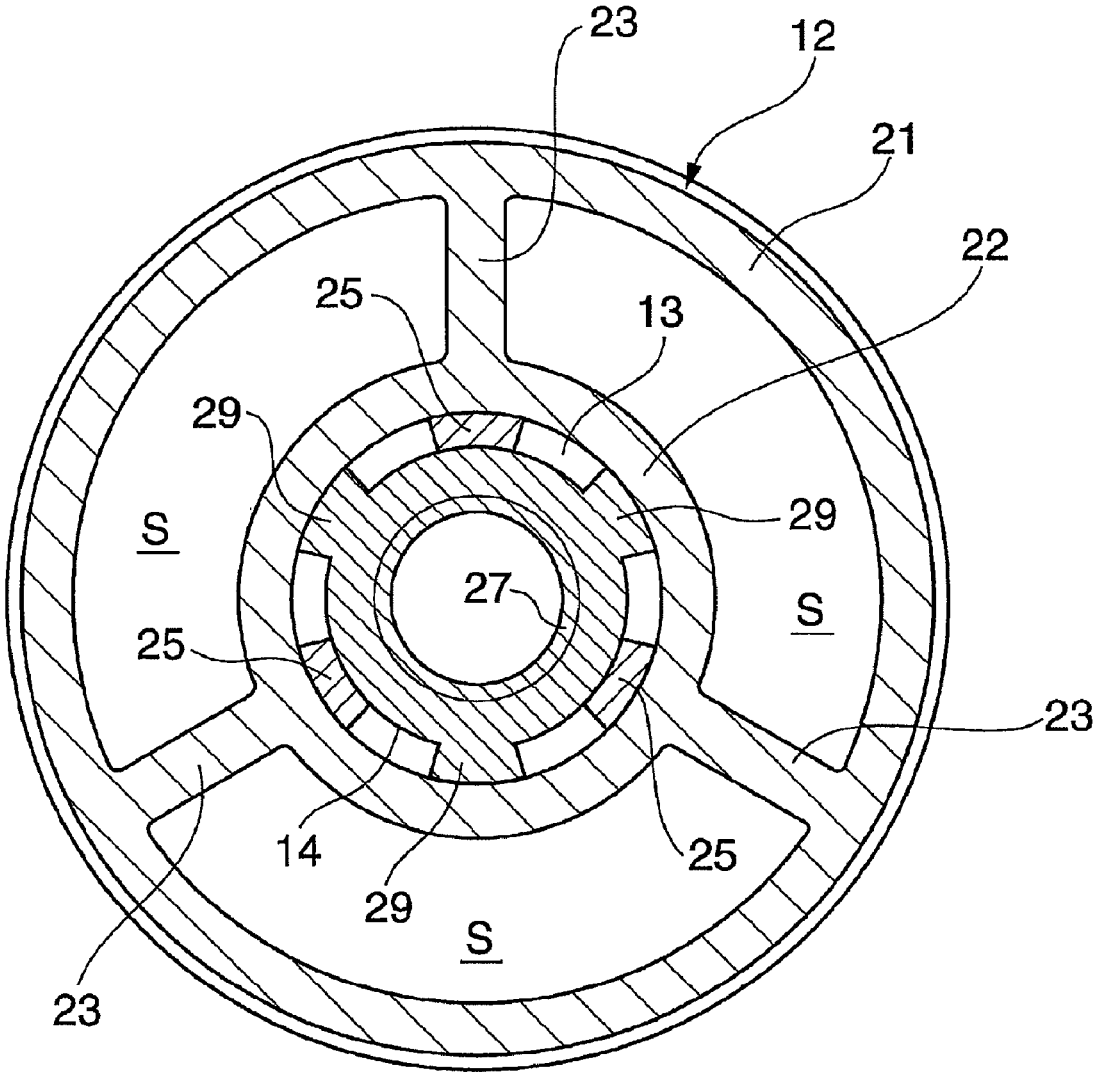
FIG. 2 is a cross sectional view taken along the line II-II of FIG. 1.
Figure 3:
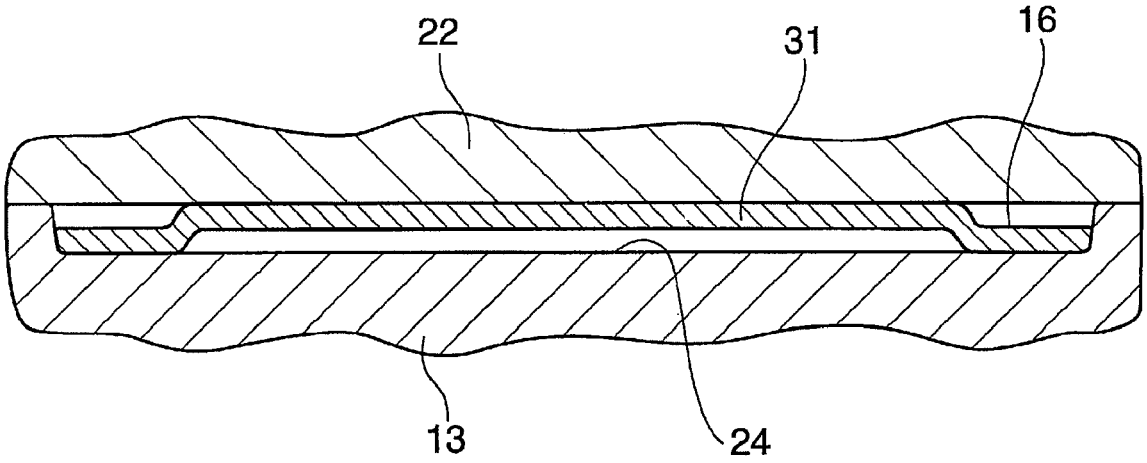
FIG. 3 is an enlarged cross sectional view of a portion of a torque limiter that can be used with the propeller of FIG. 1.
Figure 4:
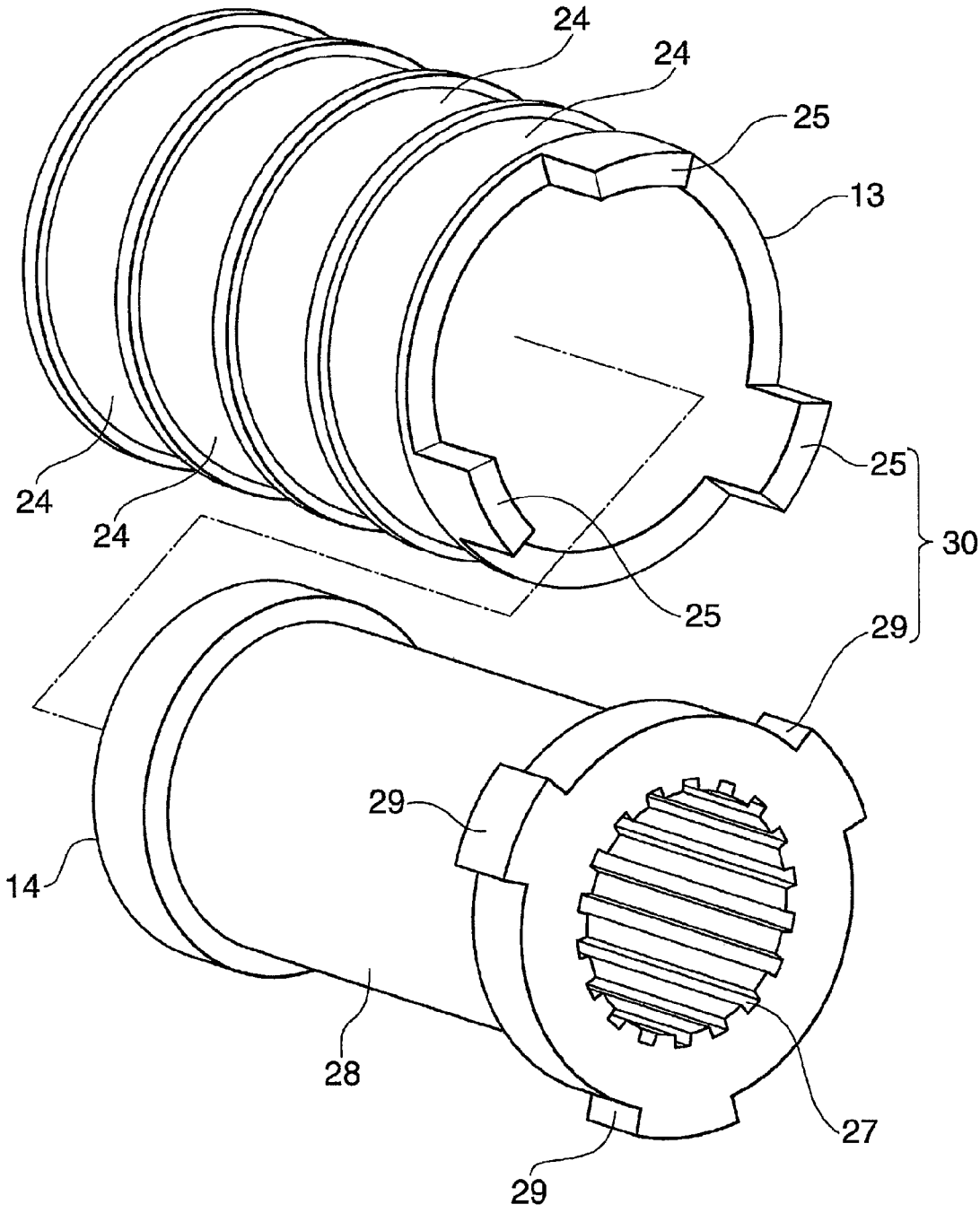
FIG. 4 is an exploded perspective view of an inner tube and an outer tube members that can be used with the propeller of FIG. 1.
Figure 5:
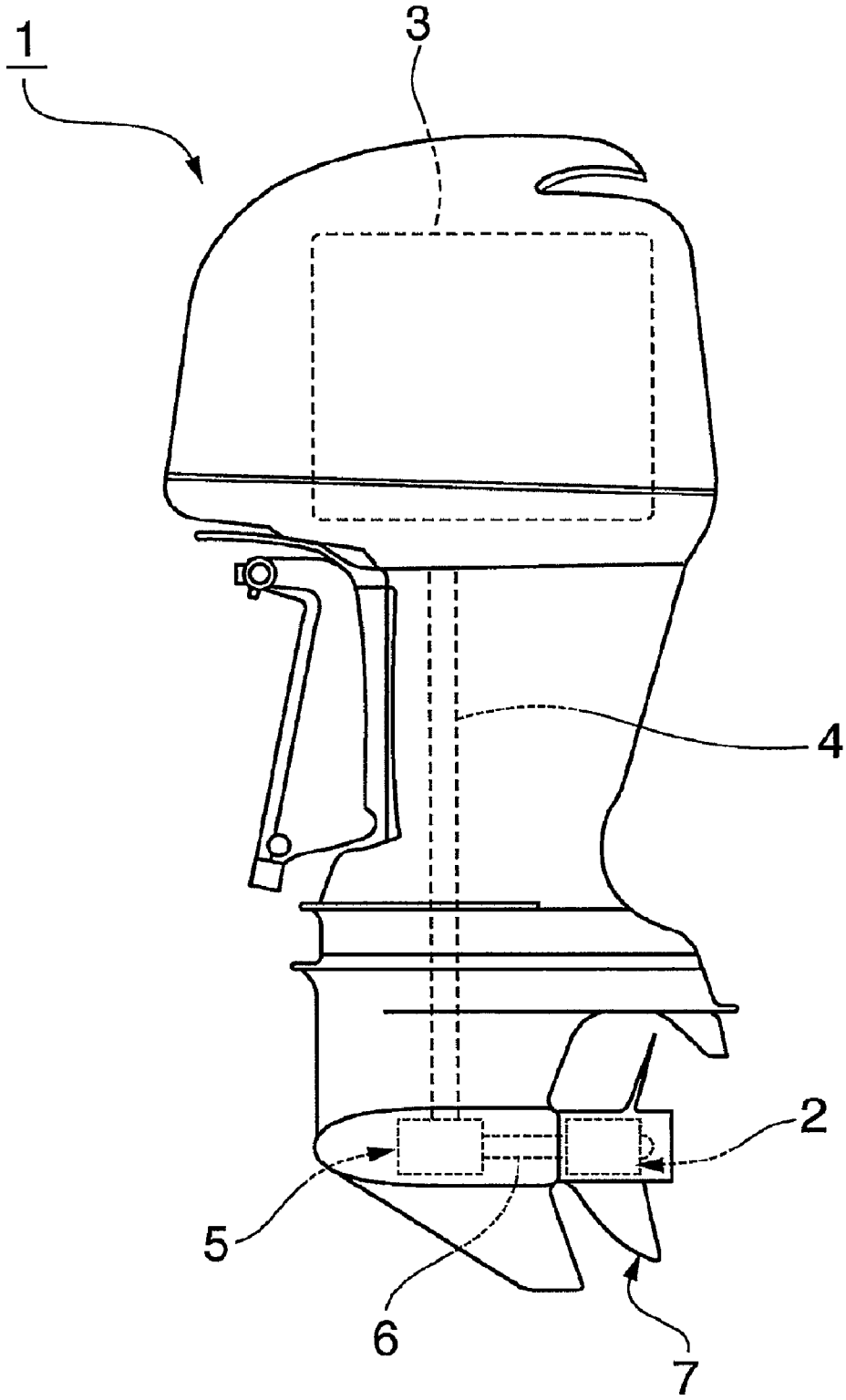
FIG. 5 is a side elevational view of an outboard motor having the shock absorbing illustrated in FIGS. 1-4.
Figure 6:
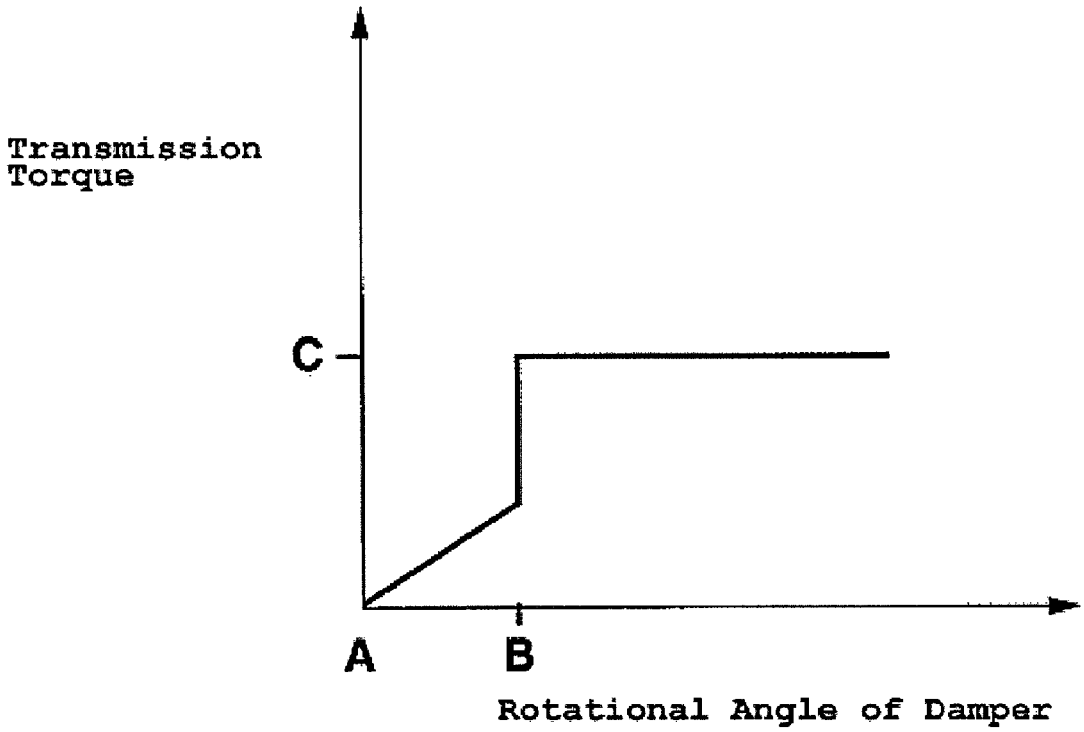
FIG. 6 is a graph illustrating an exemplary characteristic of a rubber damper that can be sued with the propeller of FIGS. 1-4.

FIG. 1 is a vertical cross sectional view of a propeller incorporating a shock absorbing device according to an embodiment. FIG. 2 is a cross sectional view taken along the line II-II of FIG. 1. FIG. 3 is an enlarged cross sectional view of a portion of a torque limiter. FIG. 4 is an illustration showing perspective views of an inner tube and an outer tube which are disassembled from each other. FIG. 5 is a side elevational view of an outboard motor having the shock absorbing device according to the present invention. FIG. 6 is a graph showing a characteristic of a rubber damper.

In FIG. 5, reference numeral 1 indicates an outboard motor having a shock absorbing device 2 according to an embodiment. The outboard motor 1 includes an engine 3, a driveshaft 4 extending downwardly from the engine 3, a shift mechanism 5 coupled with a bottom end of the driveshaft 4 for changing a shift position between a forward position and a reverse position, a propeller shaft 6 extending rearward of the outboard motor 1 from the shift mechanism 5 and a propeller 7 positioned at a rear end of the propeller shaft 6.

The shift mechanism 5 can have a structure equivalent to that incorporated in a conventional outboard motor, and is constructed so that the power is transmitted to the propeller shaft 6 through a dog clutch (not shown).

As shown in FIGS. 1 and 2, the propeller 7 can include an outer tube 12 having a plurality of blades 11 unitarily formed therewith, an intermediate tube 13 positioned inside of the outer tube 12, an inner tube 14 positioned inside of the intermediate tube 13, a damper 15 positioned between the inner tube 14 and the intermediate tube 13, and tolerance rings 16 positioned between the intermediate tube 13 and the outer tube 12. The damper 15 can be made from rubber, or other elastic materials. In some embodiments, the damper 15 can be considered as forming an elastic member. However, other devices or members can also be used to define an elastic member.

Also, in some embodiments, the inner tube 14 can be considered as forming a tube positioned inside of the elastic member 15 and the intermediate tube 13 can be considered as forming a tube positioned outside of the elastic member 15. However, other devices or members can also be used to define such tubes.

The outer tube 12 can include an outer cylindrical section 21 from which the blades 11 extend outwardly, an inner cylindrical section 22 positioned inside of the outer cylindrical section 21 to coaxially extend therewith, and a plurality of connecting plate sections 23 connecting the cylindrical sections 21, 22 to each other. The outer cylindrical section 21 and the inner cylindrical section 22 are generally cylindrically shaped. The outboard motor 1 (FIG. 5) having the propeller 7 can employ a structure in which exhaust gases are discharged rearwardly (rightwardly in FIG. 1) through a space S defined between the outer cylindrical section 21 and the inner cylindrical section 22.

The intermediate tube 13 can be cylindrically shaped and can rotatably fit in the inner cylindrical section 22. As shown in FIG. 4, an outer circumferential surface of the intermediate tube 13 can have circular grooves 24 into which the tolerance rings 16 (FIG. 3) can be fit. The tolerance rings 16 are described in greater detail below with reference to FIG. 3. In some embodiments, the intermediate tube 13 can have four circular grooves 24 so that four tolerance rings 16 can be attached.

Also, as shown in FIG. 4, three first engaging sections 25 can project rearwardly from a rear end of the intermediate tube 13. The respective first engaging sections 25 can be placed at positions which equally divide the intermediate tube 13 into three portions in its circumferential direction.

The inner tube 14 can be cylindrically shaped and can be rotatably fit in the intermediate tube 13 to abut on an inner circumferential surface thereof. As shown in FIG. 1, a core portion of the inner tube 14 can define a shaft hole 26 into which the propeller shaft 6 (FIG. 5) fit. Splines 27 can be formed around the hole 26 and can be sized to engage corresponding splines (not shown) on the propeller shaft 6.

As shown in FIGS. 1 and 4, a central area of an outer circumferential surface of the inner tube 14 can have a smaller diameter portion 28 to which a damper 15 is mounted. The damper 15 is described in greater detail below. Second engaging sections 29 can extend from a rear end of the inner tube 14 to engage with the first engaging sections 25.

The second engaging sections 29 can project outwardly in a radial direction of the inner tube 14 to equally divide the inner tube 14 into three portions in its circumferential direction. For example, the respective second engaging sections 29 can extend to oppose the neighboring first engaging sections 25 with a certain space in the circumferential direction under the condition that the inner tube 14 fits in the intermediate tube 13. That is, the inner tube 14 can rotate relative to the intermediate tube 13 until the respective first engaging sections 25 contact with the neighboring second engaging sections 29. The first engaging sections 25 and the second engaging sections 29 can be considered as forming engaging device 30. However, other configurations can also be used as forming engaging means.

The damper 15 together with the engaging sections 25, 29 can be considered as forming dampening means. However, other configurations can also be considered as forming dampening means.

The damper 15 can be cylindrically shaped so as to fill the small diameter portion 28 of the inner tube 14. In some embodiments, an inner circumferential surface of the damper 15 can be affixed to an outer circumferential surface of the small diameter portion 28 by being vulcanized. In some embodiments, an outer circumferential surface of the damper 15 is affixed to an inner circumferential surface of the intermediate tube 13 by being vulcanized. However, other techniques can also be used to affix the damper 15 to the inner and outer surfaces. As such, the power transmitted from the propeller shaft 6 to the inner tube 14 is transmitted to the intermediate tube 13 through the damper 15.

The damper 15, in some embodiments, has a spring constant with which elastic deformation thereof begins at a moment that the propeller shaft 6 initiates its rotation. Because of this condition, when the dog clutch of the shift mechanism is engaged while the propeller shaft 6 is stopped, i.e., when the propeller shaft 6 is stopped and abruptly starts rotating and reaches a rotational speed corresponding to an idling speed of the engine 3 at the next moment, the torque transmitted from the propeller shaft 6 to the blades 11 does not become large because the damper 15 is elastically deformed during the acceleration from the stopped condition to the moving condition. In other words, the damper 15 attenuates the shock from the engagement of the dog clutch.

On the other hand, if the propeller shaft 6 and the blades 11 were Rigidly coupled with each other, e.g., without the damper 15, a large shock would be transmitted to the engine 3 through the power transmission system because the blades 11 instantly start moving against the water resistance. The shock is further transmitted to the hull of the associated watercraft from the outboard motor 1. However, the shock absorbing device 2 can attenuate the shock, with, in some embodiments, the damper 15. The transmission of the shock to the hull is thus attenuated.

When the damper 15 is elastically deform ed with the rotation of the propeller shaft 6, the inner tube 14 slightly rotates relative to the intermediate tube 13. Thus, an amount of the elastic deformation of the damper 15 increases until the respective second engaging sections 29 contact with the neighboring first engaging sections 25. When the first and second engaging sections 25, 29 contact with each other, the damper 15 is prevented from being further elastically deformed and the power is directly transmitted from the inner tube 14 to the intermediate tube 13.

Therefore, if the spring constant of the damper 15 is sufficiently low, and there are no other devices provided for reducing the relative movement of the tubes, 13, 14, the first engaging sections 25 contact with the second engaging sections 29 in a broad operational range covering from a low speed operational condition in which the thrust of the propeller 7 is relatively small such as, for example, a trolling operation to a high speed running condition. Through this range, the power would be directly transmitted from the inner tube 14 to the intermediate tube 13 through the first and second engaging sections 25, 29.

The tolerance rings 16 can also be considered as forming damping means. However, other devices and/or configurations can also be considered as forming dampening means.

In some embodiments, each tolerance ring 16 is made of stainless steel and shaped as the letter "C" in the axial direction. As shown in FIG. 3, a central portion of each tolerance ring 16 in the axial direction has swelling sections 31 protruding outward in the diametrical direction. That is, each tolerance ring 16 has a plurality of the swelling sections 31 spaced apart from each other in the circumferential direction. A height of each swelling section 31 is decided in such a manner that an outer surface of the swelling section 31 projects beyond the outer circumferential surface of the intermediate tube 13 in the diametrical direction under the condition that the tolerance ring 16 fits in the circular groove 24.

Each tolerance ring 16 can be press-fit in the circular groove 24 of the intermediate tube 13 so as to be interposed between the intermediate tube 13 and the inner circumferential surface of the inner cylindrical section 22. The press-fitting can be made in such a manner that the intermediate tube 13 is fitted into the interior of the inner cylindrical section 22 under the condition that the respective tolerance rings 16 are placed in the associated circular grooves 24.

As shown in FIG. 3, inner circumferential surfaces of each tolerance ring 16 press-fitted in the space between the intermediate tube 13 and the inner cylindrical section 22 tightly contact with a bottom surface of the circular groove 24, and an outer surface of the swelling section 31 tightly contact with the inner circumferential surface of the inner cylindrical section 22. That is, under the condition that the tolerance rings 16 are placed between the intermediate tube 13 and the inner cylindrical section 22, the power transmitted to the intermediate tube 13 is transmitted to the inner cylindrical section 22 of the outer tube 12 through the tolerance rings 16.

A magnitude of the torque that can be transmitted through the tolerance rings 16 corresponds to a magnitude of the frictional resistance of the respective portions which tightly contact with each other. The tolerance rings 16 in some embodiments can transmit the torque that is necessary for the watercraft to run in a high speed range. If, however, the transmission torque becomes significantly large under any conditions such that the propeller 7 strikes a piece of driftwood or a rock located at the bottom of the sea, the inner circumferential surfaces of the respective tolerance rings 16 slip relative to the intermediate tube 13 or the outer circumferential surfaces thereof slip relative to the inner cylindrical section 22. That is, the respective tolerance rings 16 function as a friction-type torque limiter to prevent any shock loads from being inflicted to the power transmission system including the propeller 7.

In some embodiments of the shock absorbing device 2 as described above, the damper 15 starts being elastically deformed from the moment that the dog clutch of the shift mechanism is engaged. Thus, the torque transmitted to the blades 11 in this state can gradually increase to prevent the shock from being made.

FIG. 6 illustrates a change of the transmission torque relative to a rotational angle of the damper (i.e., a rotational angle of the propeller 6 relative to the outer tube 12) when the damper 15 is elastically deformed. In FIG. 6, point A indicates a time at which the dog clutch of the shift mechanism is engaged, point B indicates a time at which the first engaging sections 25 and the second engaging sections 29 contact with each other and the power is transmitted without going through the damper 15.

As can be understood from FIG. 6, when the second engaging sections 29 contact with the first engaging sections 25 (at point B), the inner tube 14 is rigidly coupled with the intermediate tube 13. Thus, the rotational angle of the damper does not increase. Consequently, the power is transmitted to the blades 11 through the power transmission system, for example, from the inner tube 14 to the damping means 30, then to the intermediate tube 13, then to the tolerance rings 16 and then to the outer tube 12.

If the propeller 7 strikes a piece of driftwood or a rock located at the bottom of the sea under the operational condition, the transmission torque abruptly increases. When the transmission torque exceeds the maximum torque (point C of FIG. 6) which is determined in accordance with the frictional resistance of the tolerance rings 16, the tolerance rings 16 slip relative to the intermediate tube 13 or the inner cylindrical section 22 of the outer tube 12 (i.e., the torque limiter works) to block the power transmission.

Therefore, according to some embodiments of the shock absorbing device 2, the shock made when the dog clutch of the shift mechanism is engaged can be dampened and the shock made when the propeller 7 strikes a certain object can be also damped. The members of the power transmission system thus can be prevented from being damaged.

In the shock absorbing device 2 for a watercraft propeller according to some embodiments, the engaging device 30 can be formed with the first engaging sections 25 extending from one end of the intermediate tube 13 in the axial direction thereof, and second engaging sections 29 extending from the inner tube 14 so as to oppose the respective first engaging sections 25 with the space in the circumferential direction thereof. Thus, the engaging device 30 and the damper 15 extend along each other in the axial direction thereof. Therefore, even though the torque limiter is provided, the propeller 7 can be compactly formed in its diametrical direction.

In the shock absorbing device 2 for a watercraft propeller according to some embodiments, the torque limiter is formed with the tolerance rings 16 tightly contacting with the outer circumferential surface of the intermediate tube 13 and the inner circumferential surface of the inner cylindrical section 22. The torque limiter thus can be compactly formed in the diametrical direction. Alternatively, the torque limiter can be made of a cylindrical rubber member, for example, other than the tolerance rings 16. In order to employ this alternative structure, the cylindrical rubber member is elastically fitted in the space between the intermediate tube 13 and the inner cylindrical section 22 under the condition that the cylindrical rubber member tightly contacting with at least one of the outer circumferential surface of the intermediate tube 13 and the inner surface of the inner cylindrical section 22. For example, first, an inner circumferential surface of the rubber member is affixed to the outer circumferential surface of the intermediate tube 13 and then an outer circumferential portion of the rubber member is press-fitted into an inner circumferential portion of the inner cylindrical section 22.

In such embodiments, the rubber member can have a spring constant larger than that of the damper 15 disposed between the inner tube 14 and the intermediate tube 13 so that this additional rubber member can transmit the power that is necessary for the high speed running of the watercraft. Because this kind of cylindrical rubber member can be produced at lower costs than the tolerance rings, the production costs of the shock absorbing device 2 can be reduced by forming the torque limiter using the rubber member.

The torque limiter in such embodiments described above is positioned outside of the damper 15. Alternatively, the shock absorbing device 2 according to some embodiments can have the torque limiter positioned between the inner tube 14 and the intermediate tube 13 and the damper 15 positioned between the intermediate tube 13 and the outer tube 12 (inner cylindrical section 22).

One of the damping means in some of the embodiments described above is formed with the rubber damper. Alternatively, the damping means can be formed with a spring instead of the rubber damper. However, because the one of the damping means is formed with the rubber damper, the structure is simple and the rubber damper can be compactly placed between the intermediate tube 13 and the inner tube 14.

In addition, the shock absorbing device according to some embodiments, is applied to the propeller of the outboard motor in the embodiment described above. Alternatively, the shock absorbing device can be applied to a propeller for other watercraft propulsion devices such as, for example, a stern drive.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A shock absorbing device for a watercraft propeller, comprising:

an outer tube that is unitary with a blade of a propeller;

an inner tube positioned in the outer tube and coupled with a propeller shaft;

an intermediate tube positioned between the outer tube and the inner tube;

a first damping device located between the intermediate tube and the outer tube; and second damping device located between the intermediate tube and the inner tube; wherein one of the first damping device and the second damping device includes:

an elastic member having a spring constant with which elastic deformation of the elastic member begins at a moment that the propeller shaft initiates rotation thereof, the elastic member being interposed between one of the tubes and another one of the tubes, and an engaging device arranged to limit an angle range in which the one of the tubes and the another one of the tubes are rotatable relative to each other to a predetermined angle range, each of the one of the tubes and the another one of the tubes being rotatable; and the other of the first and the second damping devices includes a torque limiter having a circumferential surface that slips against frictional resistance when transmission torque exceeds a predetermined amount of torque.

2. The shock absorbing device for a watercraft propeller according to claim 1, wherein the engaging device includes a first engaging section extending from an end of the one of the tubes in an axial direction thereof, and a second engaging section extending from the another one of the tubes so as to oppose the first engaging section with a space defined in a circumferential direction therebetween.

3. The shock absorbing device for a watercraft propeller according to claim 2, wherein the torque limiter includes a metal ring elastically deformable in a diametric direction thereof so as to tightly contact with an outer circumferential surface of the one of the tubes and with an inner circumferential surface of the another one of the tubes.

4. The shock absorbing device for a watercraft propeller according to claim 3, wherein the elastic member is made of a rubber material.

5. The shock absorbing device for a watercraft propeller according to claim 2 wherein the torque limiter includes a cylindrical rubber member tightly contacting at least with one of an outer circumferential surface of the one of the tubes or with an inner circumferential surface of the another one of the tubes.

6. The shock absorbing device for a watercraft propeller according to claim 5, wherein the elastic member is made of a rubber material.

7. The shock absorbing device for a watercraft propeller according to claim 2, wherein the elastic member is made of a rubber material.

8. The shock absorbing device for a watercraft propeller according to claim 1, wherein the torque limiter includes a metal ring elastically deformable in a diametric direction thereof so as to tightly contact with an outer circumferential surface of the one of the tubes and with an inner circumferential surface of the another one of the tubes.

9. The shock absorbing device for a watercraft propeller according to claim 8, wherein the elastic member is made of a rubber material.

10. The shock absorbing device for a watercraft propeller according to 1, wherein the torque limiter includes a cylindrical rubber member tightly contacting at least with one of an outer circumferential surface of the one of the tubes or with an inner circumferential surface of the another one of the tubes.

11. The shock absorbing device for a watercraft propeller according to claim 10, wherein the elastic member is made of a rubber material.

12. The shock absorbing device for a watercraft propeller according to claim 1, wherein the elastic member is made of a rubber material.

13. A shock absorbing device for a watercraft propeller, comprising:

an outer tube that is unitary with a blade of a propeller;

an inner tube positioned in the outer tube and coupled with a propeller shaft;

an intermediate tube positioned between the outer tube and the inner tube;

a first damping device located between the intermediate tube and the outer tube; and a second damping device located between the intermediate tube and the inner tube; wherein one of the first and second damping devices is arranged to absorb shocks and the other of the first and second damping devices is arranged to limit torque transmitted thereby; and one of the first and second damping devices includes:

an elastic member fixed to an outer surface of one of the tubes and to an inner surface of another one of the tubes; and an engaging device arranged to limit an angle range in which the one of the tubes and the another of the tubes are rotatable relative to each other to a predetermined angle range, each of the one of the tubes and the another one of the tubes being rotatable.

14. The shock absorbing device for a watercraft propeller according to claim 13, wherein the elastic member is vulcanized and fixed to the inner and intermediate tubes.

15. The shock absorbing device for a watercraft propeller according to claim 13, wherein the first damping device is a member arranged between an outer surface of the intermediate tube and an inner surface of the outer tube.

16. The shock absorbing device for a watercraft propeller according to claim 15, wherein the first damping device is configured to generate sufficient friction to transfer torque from the intermediate tube to the outer tube.

* * * * *

UNITED STATES PATENT AND TRADEMARK OFFICE

CERTIFICATE OF CORRECTION

PATENT NO. : 7,635,252 B2
APPLICATION NO. : 11/516819
DATED : December 22, 2009
INVENTOR(S) : Hiroshi Harada It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 601 days.

Signed and Sealed this

Ninth Day of November, 2010

David J. Kappos

David J. Kappos
*Director of the United States Patent and Trademark Office*